US010584300B2

(12) United States Patent
Hartley et al.

(10) Patent No.: US 10,584,300 B2
(45) Date of Patent: Mar. 10, 2020

(54) LUBRICATING OIL COMPOSITIONS

(71) Applicant: Infineum International Limited, Abingdon (GB)

(72) Inventors: Joseph P. Hartley, Oxford (GB); Anne W. Young, Brooklyn, NY (US)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 15/907,320

(22) Filed: Feb. 28, 2018

(65) Prior Publication Data

US 2018/0251700 A1 Sep. 6, 2018

(30) Foreign Application Priority Data

Mar. 1, 2017 (EP) ..... 17158720

(51) Int. Cl.

| | |
|---|---|
| ***C10M 163/00*** | (2006.01) |
| ***C10M 159/24*** | (2006.01) |
| ***C10M 141/12*** | (2006.01) |
| ***C10M 169/04*** | (2006.01) |
| ***C10M 159/00*** | (2006.01) |
| ***C10M 129/54*** | (2006.01) |
| ***C10M 139/00*** | (2006.01) |

(52) U.S. Cl.

CPC ..... *C10M 141/12* (2013.01); *C10M 129/54* (2013.01); *C10M 139/00* (2013.01); *C10M 159/00* (2013.01); *C10M 163/00* (2013.01); *C10M 169/04* (2013.01); *C10M 169/044* (2013.01); *C10M 2207/144* (2013.01); *C10M 2215/28* (2013.01); *C10M 2217/06* (2013.01); *C10M 2227/00* (2013.01); *C10N 2210/02* (2013.01); *C10N 2230/04* (2013.01); *C10N 2240/104* (2013.01); *C10N 2240/108* (2013.01); *C10N 2260/14* (2013.01)

(58) Field of Classification Search

CPC ..... C10M 139/06; C10M 2207/028
USPC ..... 508/186, 39
See application file for complete search history.

(56) References Cited

U.S. PATENT DOCUMENTS

| | | | |
|---|---|---|---|
| 3,480,540 | A | 11/1969 | Texaco |
| 3,907,691 | A | 9/1975 | King et al. |
| 6,300,291 | B1 | 10/2001 | Hartley et al. |
| 2007/0184992 | A1 | 8/2007 | Takeuchi et al. |

(Continued)

FOREIGN PATENT DOCUMENTS

| | | | |
|---|---|---|---|
| WO | 2016/138227 | A1 | 9/2016 |
| WO | WO-2017/011633 | A1 | 1/2017 |

*Primary Examiner* — Prem C Singh
*Assistant Examiner* — Francis C Campanell

(57) ABSTRACT

A lubricating oil composition, a method of reducing low-speed pre-ignition (LSPI) in a direct-injected spark-ignited internal combustion engine, and a use of a lubricant composition to reduce LSPI events in such an engine. Preferably, the composition comprises a detergent package comprising a borated calcium detergent, wherein the detergent package provides a calcium content in the composition of at least 0.12 mass %, based on the total mass of the composition, and wherein the borated calcium detergent provides a boron content in the composition of at least 100 ppmm, based on the total mass of the composition. Optionally, the composition comprises a first detergent comprising a calcium detergent, and a second detergent comprising a borated calcium detergent.

18 Claims, 1 Drawing Sheet

(56) References Cited

U.S. PATENT DOCUMENTS

| | | | | |
|---|---|---|---|---|
| 2009/0111721 | A1 | 4/2009 | Boffa | |
| 2012/0142564 | A1* | 6/2012 | Duchesne | C10M 159/24<br>508/186 |
| 2015/0344805 | A1* | 12/2015 | Dance | C10M 157/04<br>508/293 |

* cited by examiner

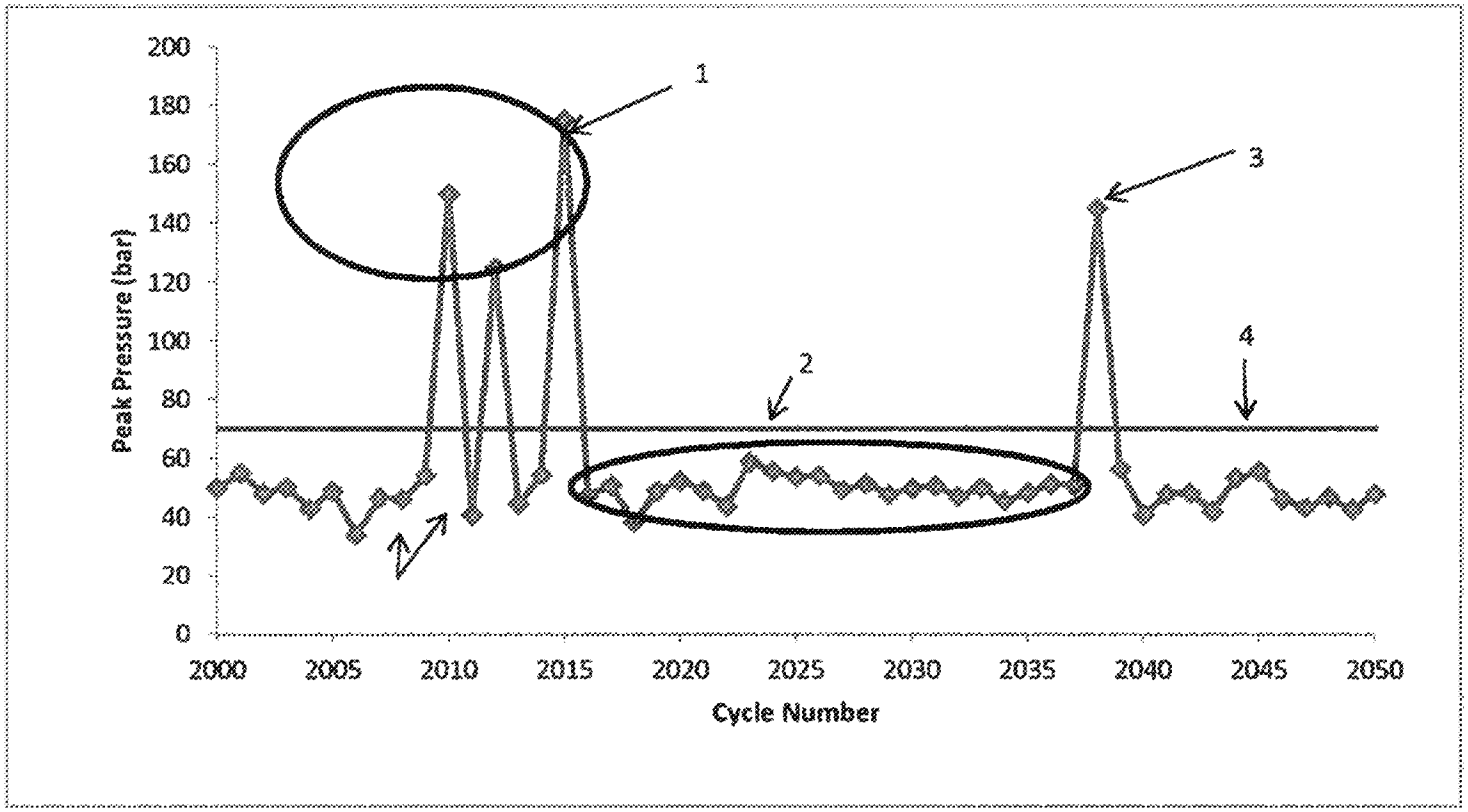
Peak Pressure (bar)
200
180
160
140
120
100
80
60
40
20
0
2000
2005
2010
2015
2020
2025
2030
2035
2040
2045
2050
Cycle Number
1
2
3
4

LUBRICATING OIL COMPOSITIONS

FIELD OF THE INVENTION

The present invention concerns lubricating compositions. More particularly, but not exclusively, this invention concerns lubricating compositions for reducing the occurrence of Low Speed Pre-Ignition (LPSI) (or low speed pre-ignition events) in spark-ignited internal combustion engines, in which a lubricating oil composition having a defined detergent package is used to lubricate the engine crankcase.

BACKGROUND OF THE INVENTION

Market demand, as well as governmental legislation, has led automotive manufacturers to continuously improve fuel economy and reduce $CO_2$ emissions across engine families, while simultaneously maintaining performance (horsepower). Using smaller engines providing higher power densities, increasing boost pressure, by using turbochargers or superchargers to increase specific output and downspeeding the engine by using higher transmission gear ratios allowed by higher torque generation at lower engine speeds have allowed engine manufacturers to provide excellent, performance while reducing frictional and pumping losses. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure. The possibility of LSPI prevents engine manufacturers from fully optimizing engine torque at lower engine speed in such smaller, high-output engines.

While not wishing to be bound by any specific theory, it is believed that LSPI may be caused, at least in part, by auto-ignition of droplets, e.g. comprising engine oil, or a mixture of engine oil, fuel and/or deposits, that enter the engine combustion chamber from the piston crevice (space between the piston ring pack and cylinder liner) under high pressure, during periods in which the engine is operating at low speeds, and compression stroke time is longest (e.g., an engine having a 7.5 msec compression stroke at 4000 rpm may have a 24 msec compression stroke when operating at 1250 rpm). Therefore, it would be advantageous to identify and provide lubricating oil compositions that are resistant to auto-ignition and therefore prevent or ameliorate the occurrence of LSPI.

WO2015/42337 considers the use of ashless antioxidant additives for reducing LSPI events. WO2015/142340 considers the use of metal overbased detergents for reducing LSPI events. WO2015/4171980 relates to a method of reducing LSPI events by providing a boron-containing compound comprising a borated dispersant or a mixture of boron-containing compound and a non-borated dispersant.

The prior art has also recognised that reducing the calcium content of a lubricating oil formulation can lead to a reduction in LSPI events, see for example, EP 2940110. However, detergents are often considered to be necessary additives for maintaining basic engine oils performance. Thus, recent efforts in providing lubricating oil formulations that reduce LSPI events have focused on replacing calcium detergents with alternative detergents. Nevertheless, there remains a need for a lubricating oil composition suitable for use in modern direct injection-spark ignition engines that reduces occurrences of LSPI events.

SUMMARY OF THE INVENTION

The present inventors have surprisingly found that use of a borated calcium detergent in a lubricating oil composition provides an unexpectedly significant reduction in the occurrence of LSPI events in direct injection-spark ignition internal combustion engines when the crankcase of the engine is imbricated with said lubricating oil composition, for example as compared to when the crankcase is lubricated with a composition comprising only a (non-borated) calcium detergent.

Thus, the present invention provides, according to a first aspect, a lubricating oil composition comprising a calcium detergent and a second detergent comprising a borated calcium detergent, wherein, the first and second detergents together provide a calcium content in the lubricating oil composition of at least 0.12 mass %, based on the total mass of the lubricating oil composition, and wherein the second detergent provides a boron content in the lubricating oil composition of at least 100 ppmm, such as at least 150 ppmm, based on the total mass of the lubricating oil composition.

According to a second aspect, the present invention provides a method of reducing low-speed pre-ignition (LSPI) events in a direct-injection spark-ignition internal combustion engine comprising lubricating the crankcase of the engine with a lubricating oil composition, the composition comprising a detergent package comprising a borated calcium detergent, wherein, the detergent package provides a calcium content in the lubricating oil composition of at least 0.12 mass %, based on the total mass of the lubricating oil composition, and wherein the borated calcium detergent provides a boron content in the lubricating oil composition of at least 100 ppmm, such as at least 150 ppmm, based on the total mass of the lubricating oil composition. Optionally, the lubricating oil composition is the lubricating oil composition of the first aspect of the invention.

According to a third aspect, the present invention provides a use of a detergent package comprising a borated calcium detergent in a lubricating oil composition to reduce LSPI events when the composition lubricates the crankcase of a direct injection-spark ignition internal combustion engine, wherein, the detergent package provides a calcium content in the lubricating oil composition of at least 0.12 mass %, based on the total mass of the lubricating oil composition, and wherein the borated calcium detergent provides a boron content in the lubricating oil composition of at least 100 ppmm, such as at least 150 ppmm, based on the total mass of the lubricating oil composition. Optionally, the lubricating oil composition is the lubricating oil composition of the first aspect of the invention.

In this specification, the following words and expressions, if and when used, have the meanings ascribed below:

"active ingredients" or "(a.i.)" refers to additive material that is not diluent or solvent;

"hydrocarbyl" means a chemical group of a compound that normally contains only hydrogen and carbon atoms and that is bonded to the remainder of the compound directly via a carbon atom but that may contain hetero atoms provided that they do not detract from the essentially hydrocarbyl nature of the group;

"oil-soluble" or "oil-dispersible", or cognate terms, do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil in employed. Moreover, the additional incorporation of other additives may also permit incorporation of other additives may also permit incorporation of higher levels of a particular additive, if desired;

"major amount" mean in excess of 50 mass % of a composition;

"minor amount" means less than or equal to 50 mass % of a composition;

"TBN" means total base number as measured by ASTM D2896 in units of mg $KOHg^{-1}$;

"phosphorus content" is measured by ASTM D5185;

"metal content" of the lubricating oil composition or of an additive component, for example molybdenum content or total metal content of the lubricating oil composition (i.e. the sum of all individual metal contents), is measured by ASTM D5185;

"boron content" is measured by ASTM D5185;

"calcium content" is as measured by ASTM 4951;

"sulphur content" is measured by ASTM D2622; and,

"sulphated ash content" is measured by ASTM D874.

Also, it will be understood that various components used, essential as well as optimal and customary, may react under conditions of formulation, storage or use and that the invention also provides the product obtainable or obtained as a result of any such reaction. Further, it is understood that any upper and lower quantity, range and ratio limits set forth herein may be independently combined. Furthermore, the constituents of this invention may be isolated or be present within a mixture and remain within the scope of the invention.

It will of course be appreciated that features described in relation to one aspect of the present invention may be incorporated into other aspects of the present invention. For example, the method of the invention may incorporate any of the features described with reference to the composition of the invention and vice versa.

BRIEF DESCRIPTION OF THE FIGURES

FIG. 1 shows graphically the occurrence of LSPI events in an engine, in accordance with the method of determining the occurrence of LSPI events as used in the Examples of the present Specification.

DETAILED DESCRIPTION

Several terms exist for various forms of abnormal combustion in spark ignited internal combustion engines including knock, extreme knock (sometimes referred to as super-knock or mega-knock), surface ignition, and pre-ignition (ignition occurring prior to spark ignition). Extreme knock occurs in the same manner as traditional knock, but with increased knock amplitude, and can be mitigated using traditional knock control methods. LSPI usually occurs at low speeds and high loads. In LSPI, initial combustion is relatively slow and similar to normal combustion, followed by a sudden increase in combustion speed. LSPI is not a runaway phenomenon, unlike some other types of abnormal combustion. Occurrences of LSPI are difficult to predict, but are often cyclical in nature.

LSPI is most likely to occur in direct-injected, boosted (turbocharged or supercharged), spark-ignited (gasoline) internal combustion engines that, in operation, generate a break mean effective pressure level of greater than about 1,500 kPa (15 bar) (peak torque), such as at least about 1,800 kPa (18 bar), particularly at least about 2,000 kPa (20 bar) at engine speeds of from about 1000 to about 2500 rotations per minute (rpm), such as at engine speeds of from about 1000 to about 2000 rpm. As used herein, break mean effective pressure (BMEP) is defined as the work accomplished during an engine cycle, divided by the engine swept volume; the engine torque normalized by engine displacement. The word "brake" denotes the actual torque or power available at the engine flywheel, as measured on a dynamometer. Thus, BMEP is a measure of the useful power output of the engine.

WO2015/171978 and WO2015171981 disclose that lubricating oils comprising a zinc dialkyl dithiophosphate compound and a borated dispersant are useful in the reduction of LSPI events. Surprisingly, the present inventors have found that the introduction of boron into a lubricating oil formulation via a borated calcium detergent is unexpectedly more effective at reducing the occurrence of LSPI events than the introduction of boron via a borated dispersant. In other words, the present inventors have found that, for a lubricating oil composition with a given boron concentration, a formulation in which boron content is provided by means of a borated calcium detergent may be more effective at reducing the frequency of LSPI events than an equivalent lubricating oil composition in which boron content is provided principally by means of a borated dispersant.

It has now been found that the occurrence of LSPI in engines can be reduced by lubricating the crankcase with lubricating oil compositions comprising a detergent package comprising a berated calcium detergent, for example a lubricating oil composition in which the detergent package provides a calcium cement in the lubricating oil composition of at least 0.12 mass %, based on the total mass of the lubricating oil composition, and wherein the berated calcium detergent provides a boron content in the lubricating oil composition of at least 100 ppmm, such as at least 150 ppmm, based on the total mass of the lubricating oil composition. Without wishing to be bound the theory, the present inventors believe that a berated calcium detergent is less susceptible to LSPI than the corresponding (non-borated) calcium detergent. Optionally, the detergent package comprises a berated calcium detergent and a calcium detergent.

More particularly, it has now been found that LSPI events can be reduced by using a lubricating oil composition comprising: a first detergent comprising a calcium detergent and a second detergent comprising a berated calcium detergent, wherein, the first and second detergents together provide a calcium content in the lubricating oil composition of at least 0.12 mass %, based on the total mass of the lubricating oil composition, and wherein the second detergent provides a boron content in the lubricating oil composition of at least 100 ppmm, such as at least 150 ppmm, based on the total mass of the lubricating oil composition.

Optionally, the first detergent comprises a calcium detergent and has a calcium cement of at least 2 mass %, based on the mass of the first detergent. Optionally, the second detergent comprises a berated calcium detergent and has a calcium content of at least 4 mass %, and a boron content of at least 1 mass %, such as at least 2 mass %, based on the mass of the second detergent.

Optionally, the first and second detergents together provide a calcium content in the lubricating oil composition of at least 0.14 mass %, preferably at least 0.16 mass %, for example at least 0.18 mass %, based on the total mass of the lubricating oil composition. Optionally, the first and second detergents together provide a calcium content in the lubricating oil composition of from 0.12 mass % to 0.35 mass %, such as from 014 mass % to 0.30 mass %, preferably from 0.16 mass % to 0.25 mass %, for example from 0.18 mass % to 0.20 wt mass %, based on the total mass of the lubricating oil composition.

Optionally, the second detergent provides a boron content in the lubricating oil composition of at least 150 ppmm, preferably at least 200 ppmm, for example at least 220 ppmm, based on the total mass of the lubricating oil composition. Optionally, the second detergent provides a boron content in the lubricating oil composition of from 100 ppmm to 800 ppmm, optionally from 150 ppmm to 750 ppmm, such as from 180 ppmm to 700 ppmm, preferably from 220 ppmm to 650 ppmm, for example from 250 ppmm to 500 ppmm, based on the weight of the lubricating oil composition.

It may be that the combination of a borated calcium detergent and a (non-borated) calcium detergent is particularly effective at providing a balance between detergent activity and reduction of LSPI.

Optionally, the lubricating oil composition has calcium content of at least 0.14 mass %, preferably at least 0.16 mass %, for example at least 0.18 mass %, based on the weight of the lubricating oil composition. Optionally, the lubricating oil composition has a calcium content of from 0.12 mass % to 0.35 mass %, such as from 0.14 mass % to 0.30 mass %, preferably from 0,16 mass % to 0.25 mass %, for example from 0.18 mass % to 0.20 mass %, based on the total mass of the lubricating oil composition. Optionally, the lubricating oil composition has a boron content of at least 100 ppmm, such as at least 150 ppmm, preferably at least 200 ppmm, for example at least 250 ppmm, based on the total mass of the lubricating oil composition. Optionally, the lubricating oil composition has a boron content of from 100 ppmm to 800 ppmm, optionally from 150 ppmm to 750 ppmm, such as from 130 ppmm to 700 ppmm, preferably from 220 ppmm to 650 ppmm, for example from 250 ppmm to 500 ppmm, based on the total mass of the lubricating oil composition.

Lubricating oil compositions suitable for use as passenger car motor oils conventionally comprise a major amount of oil of lubricating viscosity and minor amounts of performance enhancing additives, including detergents. Conveniently, boron is introduced into the lubricating oil compositions used in all aspects of the present invention by one or more borated calcium detergents. Any borated calcium detergent would be a suitable source of boron. Examples of suitable borated calcium detergents include, but are not limited to, one or more borated calcium phenate detergent, one or more borated calcium sulfonate detergent, one or more borated calcium salicylate detergent, or a mixture thereof. Preferably, such borated calcium detergents are overbased borated calcium detergents.

The borated calcium detergents of all aspects of the invention may be prepared by any conventional method. For example, it may be that the borated calcium detergent is prepared by treating a calcium detergent with boric acid. Methods of preparing borated detergents are disclosed in U.S. Pat. Nos. 3,480,548, 3,679,584, 3,829,381, 3,909,691 and 4,965,004.

Optionally, the first detergent has a calcium content of from 2 mass % to 16 mass %, such as from 4 mass % to 12 mass %, for example from 6 mass % to 10 mass %, based on the mass of the first detergent. Optionally, the second detergent has a calcium content of from 4 mass % to 16 mass %, preferably from 5 mass % to 12 mass %, for example from 6 mass % to 10 mass %, based on the mass of the second detergent. It may be that detergents having such calcium contents are particularly useful as lubricating oil additives.

Optionally, the second detergent has a boron content of from 1 mass % to 10 mass %, preferably 2 mass % to 8 mass %, for example 2 mass % to 6 mass %, based on the mass of the second detergent. It may be that a calcium detergent having such boron contents provides a particularly good balance between utility for LSPI reduction and convenience of manufacture.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail, The polar head comprises a metal salt of an acidic organic compound. The salts may contain a substantially stoichiometric amount of the metal in which case they are usually described as normal or neutral salts, and have a total base number or TBN (as can be measured by ASTM D2896) of from 0 to less than 150, such as 0 to about 80 or 100 mg KOH/g. A large amount of a metal base may be incorporated by reacting excess metal compound (e g., an oxide or hydroxide) with an acidic gas (e.g., carbon dioxide). The resulting overbased detergent comprises neutralized detergent as the outer layer of a metal base (e.g. carbonate) micelle. Such overbased detergents have a TBN of 150 mg KOH/g or greater, and typically will have a TBN of from 200 to 450 mg KOH/g or more.

Optionally, the first detergent comprises an overbased borated calcium detergent, for examples having a Total Base Number (TBN) of at least 150 mg KOH/g, preferably at least 200 mg KOH/g. Optionally, the second detergent comprises a borated overbased calcium detergent, for example having a TBN of at least 150 mg KOH/g, preferably at least 200 mg KOH/g. Optionally, the overbased borated calcium detergent and/or the berated overbased calcium detergent has a TBN of from 200 to 450 mg KOH/g, The first and second detergents are preferably used in an amount together providing the lubricating oil composition with a TBN of from about 4 to about 10 mg KOH/g, preferably from about 5 to about 8 mg KOH/g. Preferably, overbased detergents based on metals other than calcium are present in amounts contributing no greater than 60%, such as no greater than 50% or no greater than 40% of the TBN of the lubricating oil composition contributed by overbased detergent. Preferably, lubricating oil compositions of the present invention contain non-calcium-based overbased ash-containing detergents in amounts providing no greater than about 40% of the total TBN contributed to the lubricating oil composition by overbased detergent. Combinations of overbased calcium detergents may be used (e.g., comprising two or more of an overbased calcium phenate, an overbased calcium salicylate and an overbased calcium sulfonate; or comprising two or more calcium detergents each having a different TBN of greater than 150 mg KOH/g). Preferably, the first and/or second detergent will have, or have on average, a TBN of at least about 200 mg KOH/g, such as from about 200 to about 500 mg KOH/g; preferably at least about 250 mg KOH, such as from about 250 to about 500 mg KOH/g; more preferably at least about 300 mg KOH/g, such as from about 300 to about 450 mg KOH/g.

Calcium detergents that may be used in all aspects of the present invention include, oil-soluble neutral and overbased sulfonates, phenates, sulfurized phenates, thiophosphonates, salicylates, naphthenates and other oil-soluble carboxylates of calcium, and mixtures thereof. It will be appreciated that suitable calcium detergents may also comprise other metals, particularly alkali or alkaline earth metals, e.g., barium, sodium, potassium, lithium, calcium, and/or magnesium. The most commonly used additional metals are magnesium and sodium, either of which or both may be present in the calcium detergent and/or the borated calcium detergent. The first and/or second detergents may comprise combinations of detergents, whether overbased or neutral or both.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples include those obtained by alkylating benzene, xylene, naphthalene, diphenyl or their halogen derivatives such as chlombenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. In a preferred embodiment of the present invention the sulfonate detergent is not obtained by alkylation of toluene. Preferred sulfonate detergents are metal salts of alkylbenzene sulfonates.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfturized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain hetero-atoms, such as nitrogen and oxygen. Preferably, the moiety contains only carbon atoms; more preferably the moiety contains six or more carbon atoms; for example, benzene is a preferred moiety. The aromatic carboxylic acid may contain one or more aromatic moieties, such as one or more benzene rings, either fused or connected yin alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents generally useful in the formulation of lubricating oil compositions of the invention also include "hybrid" detergents formed with mixed surfactant systems, e.g., phenate/salicylates, sulfonate phenates, sulfonate/salicylates, sulfonates/phenates/salicylates, as described, for example, in U.S. Pat. Nos. 6,153,565; 6,281,179; 6,429,178; and 6,429,178.

Optionally, the first detergent comprises a calcium phenate, a calcium sulfonate and/or a calcium salicylate. In an embodiment, the first detergent comprises a calcium salicylate. Optionally, the second detergent comprises a borated calcium phenate, a borated calcium sulfonate, a borated calcium salicylate, or mixtures thereof. In an embodiment, the second detergent comprises a borated calcium salicylate. Optionally, the second detergent comprises a borated analogue of the calcium detergent of the first detergent. For example, it may be that when the first detergent comprises a calcium salicylate, the second detergent comprises a borated calcium salicylate. It may be that, for example, the borated calcium detergent of the second detergent is prepared by hosting the calcium detergent of the first detergent.

Optionally, the second detergent comprises calcium and boron in a calcium mass % to boron mass % ratio of 1:Z,based on the weight of the second detergent, wherein Z. is at least 0.1, preferably at least 0.2, for example at least 0.5. Optionally, Z is from 0.1 to 4, preferably from 0.2 to 3, for example from 0.5 to 2. It may be that such ratios provide a particularly good balance between detergent activity and reduction in LSPI.

Optionally, the first detergent and the second detergent are present in a ratio of first detergent mass % to second detergent mass % of 1:X, based on the total mass of the lubricating oil composition, wherein X is at least 0.1, preferably at least 0.2, for example at least 0.3. Optionally, X is from 0.1 to 10, preferably from 0.2 to 5, for example from 0.3 to 3.

Optionally, the first detergent comprises a plurality of calcium detergents; and/or the second detergent comprises a plurality of borated calcium detergents. Optionally, each calcium detergent of the first detergent is independently a calcium phenate, a calcium sulfonate or a calcium salicylate. Optionally, each berated calcium detergent of the second detergent is independently a berated calcium phenate, a borated calcium sulfonate or a borated calcium salicylate. Preferably, the first detergent is substantially free from any detergent that is not a calcium detergent. Preferably, the second detergent is substantially free from any detergent that is not a borated calcium detergent. In other words, it may be that the first detergent consists of one or more calcium detergents, and/or it may be that the second detergent consists of one or more borated calcium detergents. It will be appreciated that where a detergent is said to be substantially free from anything other than a particular type of detergent, or is said to consist of that particular type of detergent, the detergent may nevertheless comprise trace amounts of another material. For example, it may be that the detergent comprises a trace amount of another material left over from the preparation process used to make the detergent It will be appreciated that the first detergent is not a borated detergent (in other words, the first detergent is a non-borated calcium detergent), for example, it may be that the first detergent is substantially free from boron.

Optionally, at least 75%, for example at least 90%, such as at least 95%, or 100% of the calcium content of the lubricating oil composition is provided by the first detergent and the second detergent. Optionally, at least 50%, for example at least 75%, such as at least 90%, of the boron content of the lubricating oil composition is provided by the second detergent. It may be that when the calcium and/or boron content of the lubricating composition is provided principally by the first and second detergents, the detergent and LSPI reduction characteristics of the composition can be controlled particularly effectively.

Optionally, the composition additionally comprises a third detergent. Preferably, the third detergent is substantially free of calcium and/or boron. Optionally, the third detergent comprises one or more phenate, sulfonate or salicylate detergents, or mixtures thereof. The third detergent may be an overbased or neutral detergent. Optionally, the third detergent comprises one or more neutral metal-containing detergents (having a TBN of less than 150 mg KOH/g). These neutral metal-based detergents may be magnesium salts or salts of other alkali or alkali earth metals, except calcium. In all aspects of the invention, the first and second detergents detergent may be the sole metal-containing detergents, in which case 100% of the metal introduced into the lubricating oil composition by detergent will originate from the first and second detergents. Optionally, 100% of the metal introduced into the lubricating oil composition by detergent is calcium.

The third detergent may also contain ashless (metal-free) detergents such as hydrocarbyl phenol aldehyde condensates described, for example, in US 2005/0277559 A1.

Preferably, detergent in total is used in an amount providing the lubricating oil composition with from 0.2 to 2.0 mass %, such as from 0.2 to 1.5 mass % or from 0.3 to 1.0 mass %, more preferably from about 0.3 to about 0.8 mass % of sulfated ash (SASH).

Optionally, the composition comprises one or more additional additives from the list consisting of: dispersants, corrosion inhibitors, antioxidants, pour point depressants, antifoaming agents, supplemental anti-wear agents, friction modifiers, and viscosity modifiers.

The oil of lubricating viscosity useful in the formulation of lubricating oil compositions suitable for use in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 9 $mm^2$/sec to about 17 $mm^2$/sec, measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Also useful are synthetic oils derived from a gas to liquid process from Fischer-Tropsch synthesized hydrocarbons, which are commonly referred to as gas to liquid, or "GTL" base oils.

Esters useful as synthetic oils also include those made from $C_5$ to $C_{12}$ monocarboxylic acids and polyols and polyol esters such as neopentyl glycol, timethylolpropane, pentaerythritol, dipentaerythritol and tripentaerythritol.

Silicon-based oils such as the polyalkyl-, polyatyl-, polyalkoxy- or polyaryloxysilicone oils and silicate oils comprise another useful class of synthetic lubricants; such oils include tetraethyl silicate, tetmisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II, Group III, Group IV or Group V base stocks or base oil blends of the aforementioned base stocks. Preferably, the oil of lubricating viscosity is a Group II, Group III, Group IV or Group V base stock, or a mixture thereof, or a mixture of a Group I base stock and one or more a Group II, Group III, Group IV or Group V base stock. The base stock, or base stock blend preferably has a saturate content of at least 65%, more preferably at least 75%, such as at least 85%. Preferably, the base stock or base stock blend is a Group III or higher base stock or mixture thereof, or a mixture of a Group II base stock and a Group III or higher base stock or mixture thereof. Most preferably, the base stock, or base stock blend, has a saturate content of greater than 90%. Preferably, the oil or oil blend will have a sulfur content of less than 1 mass %, preferably less than 0.6 mass % most preferably less than 0.4 mass %, such as less than 0.3 mass %.

Preferably the volatility of the oil or oil blend, as measured by the Noack test (ASTM D5800), is less than or equal to 30 mass %, such as less than about 25 mass %, preferably less than or equal to 20 mass %, more preferably less than or equal to 15 mass %, most preferably less than or equal 13 mass %. Preferably, the viscosity index (VI) of the oil or oil blend is at least 85, preferably at least 100, most preferably from about 105 to 200.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998 Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1;

b) Group II base stocks contain greater than or equal to 90 percent saturates and less than or equal to 0.03 percent sulfur and have a viscosity index greater than or equal to 80 and less than 120 using the test methods specified in Table 1;

c) Group III base stocks contain greater than or equal to 90 percent saturates and less than or equal to 0.03 percent sulfur and have a viscosity index greater than or equal to 120 using the test methods specified in Table 1;

d) Group IV base stocks are polyalphaolefins (PAO); and, e) Group V base stocks include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2622; ASTM D 4294; ASTM D 4927; ASTM D 3120 |

The lubricating oil compositions of all aspects of the present invention may further comprise a phosphorus-containing compound.

A suitable phosphorus-containing compound includes dihydrocarbyl dithiophosphate metal salts, which are frequently used as anti-wear and antioxidant agents. The metal may be an alkali or alkaline earth metal, or aluminum, lead, tin, manganese, nickel or copper. The zinc salts are most commonly used in lubricating oil in amounts of 0.1 to 6 mass %, preferably 02 to 2 mass %, based upon the total mass of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

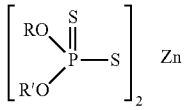

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethythexyl, phenyl, butylphenyl, cyclohexyl, methylcyclopentyl, propenyl, butenyl. In order to obtain oil solubility, the total number of carbon atoms (i.e. R and R') in the dithlophosphoric acid will generally be about 5 or greater. The zinc dihydrocarbyl dithiophosphate (ZDDP) can therefore comprise zinc dialkyl dithiophosphates. Lubricating oil compositions useful in the practice of the present invention will preferably contain ZDDP or other zinc-phosphorus compounds, in an amount introducing from 0.01 to 0.12 mass % of phosphorus, such as from 0.03 to 0.10 mass % of phosphorus, preferably, from 0.04 to 0.08 mass % of phosphorus, based on the total mass of the lubricating oil composition. Preferably, lubricating oil compositions of the present invention suitably have a phosphorous content of no greater than about 0.08 mass % (800 ppm).

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, aromatic amines, particularly secondary aromatic amines having at least two aromatic (e.g. phenyl groups) groups attached directly to the nitrogen atom, and organo-copper salts); hydroperoxide decomposers (e.g., organosulfur and organophosphorus additives); and multifunctionals (e.g. zinc dihydrocarbyl dithiophosphates, which may also function as anti-wear additives).

The lubricating oil composition in all aspects of the present invention may include an anti-oxidant, more preferably an ashless anti-oxidant. Suitably, the anti-oxidant, when present, is an ashless aromatic amine anti-oxidant, an ashless phenolic anti-oxidant or a combination thereof. The lubricating oil composition in all aspects of the present invention may include both an aromatic amine and phenolic anti-oxidant.

Suitably, the total amount of anti-oxidant (e.g. aromatic amine anti-oxidant, a phenolic anti-oxidant or a combination thereof) which may be present in the lubricating oil composition is greater than or equal to 0.05 mass %, preferably greater than or equal to 0.1 mass %, even more preferably greater than or equal to 0.2 mass %, based on the total mass of the lubricating oil composition. Suitably, the total amount of anti-oxidant which may be present in the lubricating oil composition is less than or equal to 5.0 mass %, preferably less than or equal to 3.0 mass %, even more preferably less than or equal to 2.5 mass %, based on the total mass of the lubricating oil composition Dispersants maintain in suspension materials resulting from oxidation during use that are insoluble in oil, thus preventing sludge flocculation and precipitation, or deposition on metal parts. The lubricating oil composition of the present invention comprises at least one dispersant, and may comprise a plurality of dispersants. The dispersant or dispersants are preferably nitrogen-containing dispersants and preferably contribute, in total, from 0.04 to 0.19 mass %, such as from 0.05 to 0.18 mass %, most preferably from 0.06 to 0.16 mass % of nitrogen to the lubricating oil composition.

Dispersants useful in the context of the present invention include the range of nitrogen-containing, ashless (metal-free) dispersants known to be effective to reduce formation of deposits upon use in gasoline and diesel engines, when added to lubricating oils and comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and poly-carboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Generally, each mono- or di-carboxylic acid-producing moiety will react with a nucleophilic group (amine or amide) and the number of functional groups in the polyalkenyl-substituted carboxylic acylating agent will determine the number of nucleophilic groups in the finished dispersant.

The polyalkenyl moiety of the dispersant of the present invention has a number average molecular weight of from 700 to 3000, preferably between 950 and 3000, such as between 950 and 2800, more preferably from about 950 to 2500, and most preferably from 950 to 2400. In one embodiment of the invention, the dispersant comprises a combination of a lower molecular weight dispersant (e.g., having a number average molecular weight of from 700 to 1100) and a high molecular weight dispersant having a number average molecular weight of from at least 1500, preferably between 1800 and 3000, such as between 2000 and 2800, more preferably from 2100 to 2500, and most preferably from 2150 to 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

The polyalkenyl moiety from which the high molecular weight dispersants are derived preferably have a narrow molecular weight distribution (MWD), also referred to as polydispersity, as determined by the ratio of weight average molecular weight (Mw) to number average molecular weight (Mn). Specifically, polymers from which the dispersants of the present invention are derived have a Mw/Mn of from 1.5 to 2.0, preferably from 1.5 to 1.9, most preferably from 1.6 to 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecne-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mol % of a $C_4$ to $C_{18}$ non-conjugated diolefin committer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95 or more of the polymer chains possess terminal ethenylidene-type unsaturation can be provided. The percentage of polymer chains exhibiting terminal ethenylidene unsaturation may be determined by FTIR spectroscopic analysis, titration, or $^{13}C$ NMR. Interpolymers of this latter type may be characterized by the formula POLY-$C(R^1){=}CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e., POLY-$CH{=}CH_2$, and a portion of the polymers can contain internal mono-unsaturation, e.g. POLY-$CH{=}CH(R^1)$, wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of 35 to 75 mass %, and an isobutene content of 30 to 60 mass %, in the presence of a Lewis acid catalyst, such as aluminum trichloride or boron trifluoride. A preferred sourve of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ ear $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF).

Polyisobutylene polymers that may be employed are generally based on a hydrocarbon chain of from 700 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization cart be accomplished by halogenating, e.g., chlorinating or brorninating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods.

For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain un-grafted. The free radical grafting described above can be used for the other polymers and hydrocarbons of the present invention.

The preferred monounsaturated reactants that are used to functionalize the backbone comprise mono- and di-carboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chlorornaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from equimolar amount to about 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nitrogen-containing nucleophilic reactant, such as an amine, aminoalcohol, amide, or mixture thereof; to form a corresponding derivative. Amine compounds are preferred. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of 2 to 60, such as 2 to 40 (e.g., 3 to 20) total carbon atoms having 1 to 12, such as 3 to 12, preferably 3 to 9, most preferably form 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminoproparte; 1,4-diarninobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl) cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris (hydroxymethyl)amino methane (TAM) as described in U.S. Pat. Nos. 4,102,798; 4,113,639; 4,116,876; and UK Patent No. 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

A preferred dispersant composition is one comprising at least one polyalkenyl succinimide, which is the reaction product of a polyalkenyl substituted succinic anhydride (e.g., PIBSA) and a polyamine (PAM) that has a coupling ratio of from 0.65 to 1.25, preferably from 0.8 to 1.1, most preferably from 0.9 to 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides).

The dispersant(s) of the present invention, particularly the lower molecular weight dispersants, may optionally be borated. Such dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide, boron acids, and esters of boron acids, in an amount sufficient to provide from 0.1 to 20 atomic proportions of boron for each mole of acylated nitrogen composition. It will be appreciated that any boron provided in the lubricating oil composition by the dispersant will be in addition to the boron provided by the detergent. Preferably, no more than 50 mass %, such as no more than 25 mass %, for example no more than 10 mass %, of the boron in the lubricating oil composition is provided by the dispersant.

Dispersants derived from highly reactive polyisobutylene have been found to provide lubricating oil compositions with a wear credit relative to a corresponding dispersant derived from conventional polyisobutylene. This wear credit is of particular importance in lubricants containing reduced levels of ash-containing anti-wear agents, such as ZDDP. Thus, in one preferred embodiment, at least one dispersant used in the lubricating oil compositions of the present invention is derived from highly reactive polyisobutylene.

Additional additives may be incorporated into the compositions of the invention to enable particular performance requirements to be met. Examples of additives which may be included in the lubricating oil compositions of the present invention are metal rust inhibitors, viscosity index improvers, corrosion inhibitors, oxidation inhibitors, friction modifiers, anti-foaming agents, anti-wear agents and pour point depressants. Some are discussed in further detail below.

Friction modifiers and fuel economy agents that are compatible with the other ingredients of the final oil may also be included. Examples of such materials include glyceryl monoesters of higher fatty acids, for example, glyceryl mono-oleate; esters of long chain polycarhoxylic acids with dials, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to about 250,000, preferably from about 15,000 to about 200,000, more preferably from about 20,000 to about 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Polymer molecular weight, specifically Mn, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

One class of diblock copolymers useful as viscosity modifiers has been found to provide a wear credit relative to, for example, olefin copolymer viscosity modifiers. This wear credit is of particular importance in lubricants containing reduced levels of ash-containing anti-wear agents, such as ZDDP. Thus, in one preferred embodiment, at least one viscosity modifier used in the lubricating oil compositions of the present invention is a linear diblock copolymer comprising one block derived primarily, preferably predominantly, from vinyl aromatic hydrocarbon monomer, and one block derived primarily, preferably predominantly, from diene monomer. Useful vinyl aromatic hydrocarbon monomers include those containing from 8 to about 16 carbon atoms such as aryl-substituted styrenes, alkoxy-substituted styrenes, vinyl naphthalene, alkyl-substituted vinyl naphthalenes and the like. Dienes, or diolefins, contain two double bonds, commonly located in conjugation in a 1,3 relationship. Olefins containing more than two double bonds, sometimes referred to as polyenes, are also considered within the definition of "dime" as used herein. Useful diener include those containing from 4 to about 12 carbon atoms, preferably from 8 to about 16 carbon atoms, such as 1,3-butadiene, isoprene, piperylene, methylpentadiene, phenylbutadiene, 3,4-dimethyl-1,3-hexadiene, 4,5-diethyl1,3-octadiene, with 1,3-butadiene and isoprene being preferred.

As used herein in connection with polymer block composition, "predominantly" means that the specified monomer or monomer type that is the principle component in that polymer block is present in an amount of at least 85% by mass of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and U.S. Re 27,145. Any of these methods can also be used to hydrogenate polymers containing only ethylenic unsaturation and which are free of aromatic unsaturation.

The block copolymers may include mixtures of linear diblock polymers as disclosed above, having different molecular weights and/or different vinyl aromatic contents as well as mixtures of linear block copolymers having different molecular weights and/or different vinyl aromatic contents. The use of two or more different polymers may be preferred to a single polymer depending on the rheological properties the product is intended to impart when used to produce formulated engine oil. Examples of commercially available styrene/hydrogenated isoprene linear diblock copolymers include Infineum SV140™, Infineum SV150™ and Infineum SV160™, available from Infineum USA L.P. and Wine=UK Ltd.; Lubrizol® 7318, available from The Lubrizol Corporation; and Septon 1001™ and Septon 1020™, available from Septon Company of America (Kuraray Group). Suitable styrene/1, 3-butadiene hydrogenated block copolymers are sold under the tradename Glissoviscal™ by BASF.

Pour point depressants (PPD), otherwise known as lube oil flow improvers (LOFIs) lower the temperature. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

In the present invention, it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed. In another preferred embodiment, the lubricating oil compositions of the present invention contain an effective amount of a long chain hydrocarbons functionalized by reaction with mono or dicarboxylic acids or anhydrides.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed (with the exception of detergent values) are stated as mass percent active ingredient (A.I.). As used herein, A.I. refers to additive material that is not diluent or solvent.

| ADDITIVE | MASS % (Broad) | MASS % (Preferred) |
|---|---|---|
| Dispersant | 0.1-20 | 1-8 |
| Metal Detergents | 0.1-15 | 0.2-9 |
| Corrosion inhibitor | 0-5 | 0-1.5 |

-continued

| ADDITIVE | MASS % (Broad) | MASS % (Preferred) |
|---|---|---|
| Metal Dihydrocarbyl Dithiophosphate | 0.1-6 | 0.1-4 |
| Antioxidant | 0-5 | 0.01-2.5 |
| Pour Point Depressant | 0.01-5 | 0.01-1.5 |
| Antifoaming Agent | 0-5 | 0.001-0.15 |
| Supplemental Anti-wear Agents | 0-1.0 | 0-0.5 |
| Friction Modifier | 0-5 | 0-1.5 |
| Viscosity Modifier | 0.01-10 | 0.25-3 |
| Base stock | Balance | Balance |

Preferably, the Noack volatility of the fully formulated lubricating oil composition (oil of lubricating viscosity plus all additives) will be no greater than 20 mass %, such as no greater than 15 mass %, preferably no greater than 13 mass %. Lubricating oil compositions useful in the practice of the present invention may have an overall sulfated ash content of from 0.3 to 1.2 mass %, such as from 0.4 to 1.1 mass %, preferably from 0.5 to 1.0 mass %.

It may be desirable, although not essential to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 22 mass %, typically 10 to 20 mass % of the concentrate, the remainder being oil of lubricating viscosity.

Preferably, the engine of the method of the second aspect of the invention, and/or the use of the third aspect of the invention, is an engine that generates a break mean effective pressure level of greater than 1,500 kPa, optionally greater than 2,000 kPa, at engine speeds of from 1,000 to 2,500 rotations per minute (rpm), optionally from 1,000 to 2,000 rpm.

Preferably, the lubricating oil composition in the method of the second aspect of the invention, and/or the use of the third aspect of the invention, has a calcium content of at least 0.12 mass % and a boron content of at least 100 ppmm, such as at least 150 ppmm, based on the total mass of the lubricating oil composition. Optionally, at least 50%, preferably at least 70%, such as at least 90%, of the boron content of the lubricating oil composition is provided by the detergent package, such as by the borated calcium detergent. Optionally, the borated calcium detergent has a calcium content of at least 4 mass %, such as from 4 mass % to 16 mass %, preferably from 5 mass % to 12 mass %, for example from 6 mass % to 10 mass %, and/or a boron content of at least 1 mass %, such as from 1 mass % to 10 mass %, preferably 2 mass % to 8 mass %, for example from 3 mass % to 8 mass %, based on the weight of the borated calcium detergent. Optionally, the berated calcium detergent comprises a berated overbased calcium detergent and has a TBN of at least 150 mg KOH/g, preferably at least 200 mg KOH/g, for example from 200 to 450 mg KOH/g. Optionally, the borated calcium detergent comprises a borated calcium phenate, a borated calcium sulfonate, a borated calcium salicylate, or mixtures thereof. In an embodiment, the borated calcium detergent comprises a borated calcium salicylate. Optionally, the borated calcium detergent comprises calcium and boron in a calcium mass % to boron mass % ratio of 1:Z, based on the mass of the borated calcium detergent, wherein Z is at least 0.2, preferably at least 0.5. Optionally, the lubricating composition is the lubricating composition according to the first aspect of the invention.

This invention will be further understood by reference to the following examples, wherein all parts are parts by mass, unless otherwise noted and which include preferred embodiments of the invention.

Description of the Examples

Whilst the present invention has been described and illustrated with reference to particular embodiments, it will be appreciated by those of ordinary skill in the art that the invention lends itself to many different variations not specifically illustrated herein. By way of example only, certain possible variations will now be described.

The borated calcium detergent used in the following examples was a borated calcium salicylate made according to the following method. A reactor flask equipped with Dean-Stark trap was charged with 1 kg overbased calcium salicylate having a TBN of 225 mg KOH/g and 1 kg of xylene. With stirring and under nitrogen, 124 g of boric acid was added slowly at room temperature. The temperature was then raised to 115° C. over 2 hours, then held at 115° C., for 1 hour after. The reaction mixture was then heated to 140° C. over 90 minutes followed by a 40 minute hold at 140° C. The reaction mixture was then cooled and the mixture centrifuged before concentration in vacuo on a rotary evaporator to afford approximately 1 kg of borated calcium salicylate product. ICP analysis (measured according to ASTM D4951) showed the product to have 3.09% boron and 6.77% calcium by mass. The product had a TBN (measured according to ASTM D2896) of 186 mg KOH/g.

In the following Examples, data regarding LSPI occurrences was generated using turbocharged, direct injected, GM Ecotec 2.0 liter, 4 cylinder engines, the boost level of which was modified to generate a break mean effective pressure level of about 2,300 kPa (23 bar), at an engine speed of about 2000 rpm. For each cycle (a cycle being 2 piston cycles (up/down, up/down), data was collected at 0.5° crank angle resolution. Post processing of the data included calculation of combustion metrics, verification of operating parameters being within target limits, and detection of LSPI events (statistical procedure outlined below). From the above data, outliers, which are potential occurrences of LSPI were collected. For each LSPI cycle, data recorded included peak pressure (PP), MFB02 (crank angle at 2% mass fraction burned), as well as other mass fractions (10%, 50% and 90%), cycle number and engine cylinder. A cycle was identified as having an LSPI event if either or both of the crank angle corresponding to MFB02 of the fuel and the cylinder PP are outliers. Outliers were determined relative to the distribution of a particular cylinder and test segment in which it occurs. Determination of "outliers" was an iterative process S involving calculation of the mean and standard deviation of PP and MFB02 for each segment and cylinder; and cycles with parameters that exceed n standard deviations from the mean. The number of standard deviations n, used as a limit for determining outliers, is a function of the number of cycles in the test and was calculated using the Grubbs' test for outliers, Outliers were identified in the severe tail of each distribution. That is, if n is the number of standard deviations obtained from Grubbs' test for outliers, an outlier for PP is identified as one exceeding the mean plus n standard deviations of peak pressure. Likewise, an outlier for MFB02 was identified as one being lower than the mean less a standard deviations of MFB02. Data was further examined to ensure that the outliers indicated an occurrence of LSPI, rather than some other abnormal combustion event of art electrical sensor error.

An LSPI "event" was taken as one in which there were three "normal" cycles both before and after. An LSPI event may include more than one LSPI cycle or outlier. While this method was used here, it is not part of the present invention. Studies conducted by others have counted each individual cycle, whether or not it is part of a multiple cycle event. The present definition of an LSPI event is shown in FIG. 1 wherein 1 represents a single LSPI event comprising multiple LSPI cycles. This is considered to be a single LSPI event because each single cycle was not preceded and followed by three normal events; 2 represents more than three normal events, and 3 represents a second LSPI event comprising only a single LSPI cycle. The LSPI trigger level, represented by 4, is determined by the engine used and relates to the normal function for that engine.

A series of 5W-30 grade lubricating oil compositions representing typical passenger car motor oils meeting the GF-4 specification were prepared. The formulation of these compositions is shown in Table 2 below.

TABLE 2

Comparative Example and Example Formulations

| Constituent Description | Comparative Example 1 Qty (mass %) | Comparative Example 2 Qty (mass %) | Example 1 Qty (mass %) |
|---|---|---|---|
| Borated (polyisobutylenesuccinimide-polyamine) dispersant | 0.54 | 1.92 | 0 |
| Non-Borated (polyisobutylenesuccinimide-polyamine) dispersant A | | | 5.2 |
| Non-Borated (polyisobutylenesuccinimide-polyamine) dispersant B | 5.2 | 5.2 | |
| 225 TBN Ca-salicylate detergent | 2.14 | 2.14 | 1.6 |
| 64 TBN Ca-salicylate detergent | 0.55 | 0.55 | 0.55 |
| Borated Ca-salicylate[1] detergent | | | 0.65 |
| Additive Package | 3.87 | 3.87 | 3.87 |
| Infineum V385 ™ Pour point Depressant | 0.2 | 0.2 | 0.2 |
| Infienum SV26IL ™ Viscosity modifier | 5.6 | 5.6 | 5.6 |
| Base Oil | Balance | Balance | Balance |
| Ash % | 0.78 | 0.81 | 0.81 |
| B ppm | 70 | 250 | 250 |
| Ca % | 0.184 | 0.184 | 0.184 |
| N % | 0.097 | 0.114 | 0.09 |
| P % | 0.08 | 0.08 | 0.08 |
| S % | 0.194 | 0.196 | 0.196 |

[1]The borated Ca salicylate detergent was made using the 225 TBN Ca salicylate detergent, which was borated according to the description above.

In Comparative Example 1, the formulation includes a typical, low boron concentration of 70 ppmm. In Comparative Example 2, the formulation includes a higher boron concentration of 250 ppmm, provided by means of a berated dispersant. In Example 1, the formulation includes the same boron concentration as Comparative Example 2 (250 ppmm), but the boron is provided by means of a berated detergent. This means the nitrogen content is closer to that of Comparative Example 1.

The formulations were tested for LSPI event occurrence as described above, the results being presented in Table 3.

TABLE 3

LSPI Test Results with Comparative Example and Example Formulations.

| Run | Engine | Formulation | Average LSPI Per Test |
|---|---|---|---|
| 1 | 1 | Comparative Example 1 | 35 |

TABLE 3-continued

LSPI Test Results with Comparative Example and Example Formulations.

| Run | Engine | Formulation | Average LSPI Per Test |
|---|---|---|---|
| 2 | 1 | Comparative Example 1 | 30 |
| 3 | 2 | Comparative Example 1 | 23 |
| 4 | 2 | Comparative Example 1 | 22 |
| 5 | 1 | Comparative Example 2 | 28 |
| 6 | 2 | Example 1 | 12 |

Runs 1, 2 and 5 were carried out on Engine 1, and Runs 3, 4 and 6 were carried out on Engine 2. Run 5, using the formulation of Comparative Example 2 in which additional boron was provided by the dispersant, showed a small reduction in LSPI event frequency of 14% as compared to the average LSPI event frequency of Runs 1 and 2, using the formulation of Comparative Example 1 having a typical, low boron concentration. Run 6, using the formulation of Example 1 in which additional boron was provided by the borated calcium detergent, showed a substantial reduction in LSPI event frequency of 47% as compared to the average LSPI event frequency of Runs 3 and 4, using the formulation of Comparative Example 1. Thus, the results in Table 4 show an unexpectedly large reduction in LSPI event frequency when boron is introduced into the lubricating oil composition by means of a borated detergent as compared to a berated dispersant.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

What is claimed is:

1. A method of reducing low-speed pre-ignition (LSPI) events in a direct-injection spark-ignition internal combustion engine comprising:

lubricating the crankcase of the direct-injection spark-ignition internal combustion engine with a lubricating oil composition prior to operating the engine, in which operation the engine generates a break mean effective pressure level of greater than 1,500 kPa, at engine speeds of from 1,000 to 2,500 rotations per minute (rpm), thereby reducing LSPI events during such operation, the composition comprising a detergent package comprising a borated calcium detergent;

wherein, the detergent package provides a calcium content, as measured by ASTM 4951, in the lubricating oil composition of at least 0.12 mass %, based on the total mass of the lubricating oil composition, and wherein the borated calcium detergent provides a boron content, as measured by ASTM D5185, in the lubricating oil composition of at least 100 ppmm, based on the total mass of the lubricating oil composition, and wherein the boron content from the borated calcium detergent is more efficient at reducing frequency of LSPI events during operation of the engine than an equivalent boron content introduced into the composition by means of a borated dispersant.

2. A method according to claim 1, wherein the borated calcium detergent comprises a borated overbased calcium detergent and has a TBN of at least 150 mg KOH/g, as measured by ASTM D2896.

3. A method according to claim 1, wherein the detergent package additionally comprises a further detergent.

4. A method according to claim 1, wherein the detergent package provides a calcium content, as measured by ASTM 4951, in the lubricating oil composition of at least 0.14 mass %, based on the total mass of the lubricating oil composition.

5. A method according to claim 1, wherein the detergent package provides a calcium content, as measured by ASTM 4951, in the lubricating oil composition of at least 0.16 mass %, based on the total mass of the lubricating oil composition.

6. A method according to claim 1, wherein the detergent package provides a calcium content, as measured by ASTM 4951, in the lubricating oil composition of at least 0.18 mass %, based on the total mass of the lubricating oil composition.

7. A method according to claim 1, wherein the borated calcium detergent provides a boron content, as measured by ASTM D5185, in the lubricating oil composition of at least 150 ppmm, based on the total mass of the lubricating oil composition.

8. A method according to claim 1, wherein at least 50%, of the boron content of the lubricating oil composition is provided by the borated calcium detergent.

9. A method according to claim 8, wherein 100%, of the boron content of the lubricating oil composition is provided by the borated calcium detergent.

10. A method according to claim 3, wherein the further detergent comprises non-borated calcium detergent.

11. A method according to claim 10, wherein:

the non-borated calcium detergent comprises a calcium phenate, a calcium sulfonate and/or a calcium salicylate; and the borated calcium detergent comprises a borated calcium phenate, a borated calcium sulfonate and/or a borated calcium salicylate.

12. A method according to claim 10, wherein the borated calcium detergent comprises a borated analogue of the non-borated calcium detergent.

13. A method according to claim 10, wherein the borated calcium detergent comprises calcium and boron in a calcium mass % to boron mass % ratio of 1:Z, based on the mass of the borated calcium detergent, wherein Z is at least 0.1.

14. A method according to claim 13, wherein Z is from 0.1 to 4.

15. A method according to claim 10, wherein the non-borated calcium detergent and the borated calcium detergent are present in a ratio of non-borated detergent mass % to borated detergent mass % of 1:X. based on the total mass of the lubricating oil composition, wherein X is at least 0.1.

16. A method according to claim 15, wherein X is from 0.1 to 10.

17. A method according to claim 10, wherein the non-borated calcium detergent has a calcium content of from 2 mass % to 16 mass %, based on the mass of the non-borated calcium detergent, and/or the borated calcium detergent has a calcium content of from 4 mass % to 16 mass %, based on the mass of the borated calcium detergent.

18. A method according to claim 10, wherein the second detergent has a boron content of from 1 mass % to 10 mass %, based on the mass of the second detergent.

* * * * *